US006986369B1

(12) United States Patent
Cooper et al.

(10) Patent No.: US 6,986,369 B1
(45) Date of Patent: Jan. 17, 2006

(54) ROUTER HEIGHT ADJUSTMENT APPARATUS

(75) Inventors: Randy G. Cooper, Jackson, TN (US); Greg K. Griffin, Humboldt, TN (US); Derrick Kilbourne, Jackson, TN (US); Mark A. Etter, Jackson, TN (US); Ginger L. Allen, Jackson, TN (US)

(73) Assignee: Porter-Cable Corporation, Jackson, TN (US)

( * ) Notice: Subject to any disclaimer, the term of this patent is extended or adjusted under 35 U.S.C. 154(b) by 102 days.

(21) Appl. No.: 10/292,171

(22) Filed: Nov. 12, 2002

(51) Int. Cl.
*B27C 5/10* (2006.01)

(52) U.S. Cl. ..... 144/136.95; 144/154.5; 409/182

(58) Field of Classification Search ..... 144/134.1, 144/136.1, 136.95, 154.5; 409/180–182
See application file for complete search history.

(56) References Cited

U.S. PATENT DOCUMENTS

| | | | | |
|---|---|---|---|---|
| 712,843 | A | 11/1902 | Paul | |
| 1,370,895 | A | 3/1921 | Loomis | |
| 1,514,894 | A | 11/1924 | Carter | |
| 1,565,790 | A | 12/1925 | Carter | |
| 1,584,078 | A | 5/1926 | Carter | |
| 1,820,162 | A | 8/1931 | Salvat | |
| 1,874,232 | A | 8/1932 | Groen et al. | |
| 2,353,202 | A | 7/1944 | Tautz | 144/134 |
| 2,425,245 | A | 8/1947 | Johnson | 121/36 |
| 2,504,880 | A | 4/1950 | Rittenhouse | 143/43 |
| 2,513,894 | A | 7/1950 | Rogers | 206/17 |
| 2,799,305 | A | 7/1957 | Groehn | 144/253 |
| 3,289,718 | A | 12/1966 | Willis | 144/136 |
| 3,436,090 | A | 4/1969 | Lange et al. | 280/11.37 |
| 3,443,479 | A | 5/1969 | Hawley et al. | 90/12 |
| 3,451,133 | A | 6/1969 | Hathaway et al. | 32/22 |
| 3,466,973 | A | 9/1969 | Rees | 90/12 |
| 3,481,453 | A | 12/1969 | Shreve, III et al. | 206/45.14 |
| 3,487,747 | A | 1/1970 | Burrows et al. | 90/11 |
| 3,494,395 | A | 2/1970 | Graham | 144/136 |
| 3,512,740 | A | 5/1970 | Podwalny | 248/154 |
| 3,587,387 | A | 6/1971 | Burrows et al. | 90/12 |
| 3,710,833 | A | 1/1973 | Hammer et al. | 144/134 A |
| 3,767,948 | A | 10/1973 | Batson | 310/50 |
| 3,791,260 | A | 2/1974 | Ambler et al. | 90/12 D |
| 3,827,820 | A | 8/1974 | Hoffman | 403/165 |
| 3,905,273 | A | 9/1975 | Shook | 90/11 R |
| 4,051,880 | A | 10/1977 | Hestily | 144/252 R |

(Continued)

FOREIGN PATENT DOCUMENTS

| | | |
|---|---|---|
| CA | 500134 | 2/1954 |

(Continued)

OTHER PUBLICATIONS

#9000-04 Advantage Rotary Saw™ Kit; © 2000 Dremel; http://www.dremel.com; Sep. 6, 2002.

(Continued)

*Primary Examiner*—Derris H. Banks
*Assistant Examiner*—Shelley Self
(74) *Attorney, Agent, or Firm*—Suiter West Swantz pc llo

(57) ABSTRACT

The present invention is directed to a router depth adjustment mechanism for minimizing rapid course depth adjustment for standard and plunge routers. Routers with rapid or course adjustment mechanisms may permit a router motor housing to drop suddenly, if the user in inattentive. Sudden adjustments may result in damage to the router and even user injury. The mechanism of the present invention includes a threaded shaft and a biased thread engaging member which may be disengaged for rapid adjustment. A restraining device and/or a break may be included to minimize the rate of change.

11 Claims, 9 Drawing Sheets

U.S. PATENT DOCUMENTS 4,085,552 A 4/1978 Horine et al. ..... 51/166 R
4,102,370 A 7/1978 Vess ..... 144/134 D
4,108,225 A 8/1978 Hestily ..... 144/134 D
4,143,691 A 3/1979 Robinson ..... 144/134 D
4,239,428 A 12/1980 Berzina ..... 409/182
4,294,297 A 10/1981 Kieffer ..... 144/134 D
4,319,860 A 3/1982 Beares ..... 409/182
D267,492 S 1/1983 Schieber ..... D15/141
4,410,022 A 10/1983 Peterson ..... 144/1 F
4,445,811 A 5/1984 Sanders ..... 409/182
4,537,234 A 8/1985 Onsrud ..... 144/134 A
4,562,872 A 1/1986 Fushiya et al. ..... 144/134 D
4,593,466 A 6/1986 O'Brien ..... 30/272 A
D286,132 S 10/1986 Yamamoto ..... D8/67
4,615,654 A 10/1986 Shaw ..... 409/178
4,652,191 A * 3/1987 Bernier ..... 409/182
4,679,606 A 7/1987 Bassett ..... 144/134 A
4,718,468 A 1/1988 Cowman ..... 144/134 D
4,738,571 A 4/1988 Olson et al. ..... 409/137
4,770,573 A 9/1988 Monobe ..... 409/182
D300,501 S 4/1989 Zurwelle ..... D8/67
4,830,074 A 5/1989 Lundblom ..... 144/251
RE33,045 E 9/1989 Gronholz et al. ..... 144/134
4,872,550 A 10/1989 Stranges ..... 206/315.1
4,924,571 A 5/1990 Albertson ..... 30/121
4,938,642 A 7/1990 Imahashi et al. ..... 409/182
5,012,582 A 5/1991 Bristol et al. ..... 30/391
5,025,841 A 6/1991 Totten ..... 144/134 R
5,056,375 A 10/1991 Kapton et al. ..... 74/89.15
5,062,460 A 11/1991 DeLine ..... 144/136 C
5,074,724 A 12/1991 McCracken ..... 409/182
5,078,557 A 1/1992 McCracken ..... 409/182
D323,935 S 2/1992 Ward ..... D3/73
5,088,865 A 2/1992 Beth et al. ..... 409/182
5,094,575 A 3/1992 Kieser et al. ..... 409/182
D326,597 S 6/1992 Lee ..... D8/68
5,117,879 A 6/1992 Payne ..... 144/1 F
5,139,061 A 8/1992 Neilson ..... 144/134 A
5,181,813 A 1/1993 McCracken ..... 409/182
5,188,492 A 2/1993 McCracken ..... 409/182
5,191,621 A 3/1993 Brok ..... 382/1
D337,501 S 7/1993 Witt ..... D8/70
D340,174 S 10/1993 Hoshino et al. ..... D8/67
D341,305 S 11/1993 Svetlik ..... D8/70
5,265,657 A 11/1993 Matsumoto et al. .... 144/134 D
5,273,089 A 12/1993 Fuchs et al. ..... 144/134 D
5,289,861 A 3/1994 Hedrick ..... 144/134 A
5,308,201 A 5/1994 Wilson et al. ..... 409/134
D349,637 S 8/1994 Hoshino et al. ..... D8/67
5,347,684 A 9/1994 Jackson ..... 16/111 R
5,353,474 A 10/1994 Good et al. ..... 16/111 R
5,353,852 A 10/1994 Stolzer et al. ..... 144/134 D
5,361,851 A 11/1994 Fox ..... 173/170
5,368,424 A 11/1994 Bettenhausen ..... 409/182
5,429,235 A 7/1995 Chen ..... 206/373
5,445,479 A 8/1995 Hillinger ..... 408/16
5,452,751 A 9/1995 Engler, III et al. ..... 144/1 F
5,469,601 A 11/1995 Jackson ..... 16/111 R
5,511,445 A 4/1996 Hildebrandt ..... 74/558.5
5,584,620 A 12/1996 Blickhan et al. ..... 409/137
5,590,989 A 1/1997 Mulvihill ..... 409/182
5,598,892 A 2/1997 Fox ..... 173/170
5,613,813 A 3/1997 Winchester et al. ..... 409/182
5,640,741 A 6/1997 Yano ..... 16/114 R
5,652,191 A 7/1997 Patterson ..... 502/162
5,662,440 A 9/1997 Kikuchi et al. ..... 409/182
5,671,789 A 9/1997 Stolzer et al. ..... 144/154.5
5,678,965 A 10/1997 Strick ..... 409/132
5,699,844 A 12/1997 Witt ..... 144/329
5,725,036 A 3/1998 Walter ..... 144/135.2
5,725,038 A 3/1998 Tucker et al. ..... 144/371
5,772,368 A 6/1998 Posh ..... 409/182
5,803,684 A 9/1998 Wang ..... 409/229
5,813,805 A 9/1998 Kopras ..... 408/241 R
5,829,931 A 11/1998 Doumani ..... 409/132
5,853,273 A 12/1998 Coffey ..... 409/182
5,853,274 A 12/1998 Coffey et al. ..... 409/182
5,902,080 A 5/1999 Kopras ..... 409/182
5,909,987 A 6/1999 Coffey et al. ..... 409/131
5,913,645 A 6/1999 Coffey ..... 409/182
5,918,652 A 7/1999 Tucker ..... 144/371
5,921,730 A 7/1999 Young et al. ..... 409/182
D416,460 S 11/1999 Bosten et al. ..... D8/67
5,988,241 A 11/1999 Bosten et al. ..... 144/154.5
5,998,897 A 12/1999 Bosten et al. ..... 310/89
6,050,759 A 4/2000 Bone ..... 409/182
6,065,912 A 5/2000 Bosten et al. ..... 409/134
6,079,915 A 6/2000 Bosten et al. ..... 409/182
6,079,918 A 6/2000 Buddendeck et al. ..... 409/182
6,182,723 B1 2/2001 Bosten et al. ..... 144/154.5
6,183,400 B1 2/2001 Pope ..... 482/92
D444,364 S 7/2001 Evans ..... D8/67
6,261,036 B1 7/2001 Bosten et al. ..... 409/182
6,266,850 B1 7/2001 Williams et al. ..... 16/430
6,289,952 B1 9/2001 Jones et al. ..... 144/135.2
6,305,447 B1 10/2001 Rousseau ..... 144/135.2
6,318,936 B1 11/2001 McFarlin, Jr. et al. ..... 409/131
6,419,429 B1 7/2002 Long et al. ..... 409/182
6,443,675 B1 9/2002 Kopras et al. ..... 409/182
6,443,676 B1 9/2002 Kopras ..... 409/182
6,474,378 B1 11/2002 Ryan et al. ..... 144/154.5
6,505,659 B1 1/2003 Hummel ..... 144/135.2
6,520,224 B2 2/2003 Smith ..... 144/135.2
6,520,227 B2 2/2003 McFarlin, Jr. et al. ..... 144/371
D473,439 S 4/2003 Grant et al. ..... D8/61
6,550,154 B1 4/2003 Smith ..... 33/638
6,725,892 B2 4/2004 McDonald et al. .... 144/136.95
6,726,414 B2 4/2004 Pientka et al. ..... 409/182
6,739,066 B2 5/2004 Smith ..... 33/638
6,779,954 B2 8/2004 Tomayko ..... 409/182
6,792,984 B2 9/2004 Fontaine ..... 144/135.2
2002/0020466 A1 2/2002 McFarlin, Jr. et al. ... 144/135.2
2002/0043294 A1 4/2002 McDonald et al. ..... 144/154.5
2002/0079021 A1 6/2002 Smith ..... 144/135.2
2003/0188441 A1 10/2003 Patton ..... 30/381
2003/0205292 A1 11/2003 Smith ..... 144/252.1
2003/0223835 A1 12/2003 Hummel ..... 409/182
2004/0035495 A1 2/2004 Hessenberger et al. 144/136.95
2004/0194854 A1 10/2004 McDonald et al. .... 144/136.95
2004/0200543 A1 10/2004 McDonald et al. .... 144/136.95
2004/0250891 A1 12/2004 McDonald et al. .... 144/136.95
2004/0253068 A1 12/2004 Gerhardt et al. ..... 409/182

FOREIGN PATENT DOCUMENTS

CA 657748 2/1963
CA 2314653 7/2000
GB 712071 7/1954
GB 1037969 8/1966
JP 54051247 4/1979
JP 04297645 10/1992
JP 04297646 10/1992
JP 06136286 5/1994
JP 06164544 6/1994

OTHER PUBLICATIONS http://www.dremel.com/productdisplay/tool_template2.asp?SKU=9000-04&Color=99CCFF, #9000-04 Advantage Rotary Saw Kit, Mar. 21, 2003, 1 page.

Triton TRC-001, Router Woodworking, http://www.patwarner.com/triton.html, p. 1-2, Feb. 27, 2004.

Bosch 1617 Shop Router, Parts Diagram, Jul. 1998.
Bosch Router Models, Owners Manual, p. 1-22, http//www.boschtools.com.
Triton TRC-001 Review, 3.25 Plunge Router, http://www.mv.com/users/besposito/woodworking/triton/. Feb. 27, 2004.
Triton 3 1/4hp Plunge Router Review, http:/benchmark.20m.com/reviews/TritonRouter/TritonRouterReview.html,, p. 1-4, Feb. 27, 2004.
Triton 1/2' Precision Router (TRA 001), http://www.triton.net.au/products/router__2.html, p. 1-3, Feb. 27, 2004.

* cited by examiner

ROUTER HEIGHT ADJUSTMENT APPARATUS

FIELD OF THE INVENTION

The present invention relates to the field of hand tools and particularly to an apparatus for promoting router safety.

BACKGROUND OF THE INVENTION

For instance, United States Published Patent Application 2002/0043294 A1, entitled: Router, which is hereby incorporated by reference in its entirety, describes a device which permits rapid depth adjustment. While such a device provides the ability to adjust rapidly, rapid adjustment may result in injury to the user and/or damage to the router itself. For example, when an unwary user replaces the motor housing into the router base, such as after changing a bit, the motor housing and motor may drop upon utilizing a course adjustment device, if the motor housing is not grasped.

Furthermore, if a user is forced to support the motor housing, such as to prevent damage to the router when adjusting plunge depth, the user's grasping hand or fingers may be smashed and/or pinched, upon rapid depth adjustment, due to the weight of the router motor and housing.

Moreover, routers which include grasping apparatus for aiding in grasping the base or motor housing typically include a lip or rim for at least partially supporting the weight of the router during operation and transfer. A safety problem may occur if the motor housing and grasping apparatus interact to create a pinch point where a user's finger or hand may be easily caught.

Moreover, the router itself may become damaged, such as when an adjustment mechanism is released when the router is implemented with a router table. For instance, if a user actuates the course adjustment device, the router may drop suddenly.

Therefore, it would be desirable to provide an apparatus for promoting router safety.

SUMMARY OF THE INVENTION

Accordingly, the present invention is directed to an apparatus for promoting router safety when adjusting router depth. As will be appreciated by those of skill in the art, the apparatus of the present invention may be implemented in rotary cut-off tools, both standard and plunge routers, and the like.

In a first aspect of the present invention, a router includes a motor housing, a base, an adjustment mechanism and a hand grip attachment. The adjustment mechanism includes a shaft with a threaded portion and a thread engaging member. The shaft is attached to the motor housing and is received in the base wherein the engaging member may selectively engage the threaded portion. The hand grip includes a lip for at least partially supporting the router when grasped. The lip extends generally outward from the base to which it is attached. The lip may be disposed even with or below the end of the base adjacent to the motor housing so as to minimize potential user injury.

In an additional aspect of the invention, a router adjustment device includes a base, a motor housing, a frictional zone, and an adjustment mechanism including a shaft and threaded engaging member. The motor housing may adjustably secure within the base for permitting depth adjustment. The frictional zone may be disposed either on the base or motor housing. For instance, the frictional zone is disposed generally at the interface of the motor housing and base. The frictional zone at least partially resists the movement of the motor housing, such as when the thread engaging member is disengaged from the threaded shaft.

In a further aspect of the invention, an apparatus for controlling router adjustment includes a base, a motor housing, and an adjustment mechanism. The adjustment mechanism includes a shaft, a threaded engaging member and means for at least partially restraining the motor housing from moving with respect to the base. For instance, the adjustment mechanism contains a spring for generally biasing the shaft to prevent damage and/or injury.

In another aspect of the invention, a router adjustment device includes a base, a motor housing, an adjustment mechanism, and a brake element. The motor housing is adjustably secured in the base to permit longitudinal movement. The break element is disposed in the base substantially perpendicular to the motor housing. The break element may be activated to at least partially resist the movement of the motor housing, such as when a course adjust occurs.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those killed in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 5C, exemplary embodiments of the present invention are shown.

Figure 1:
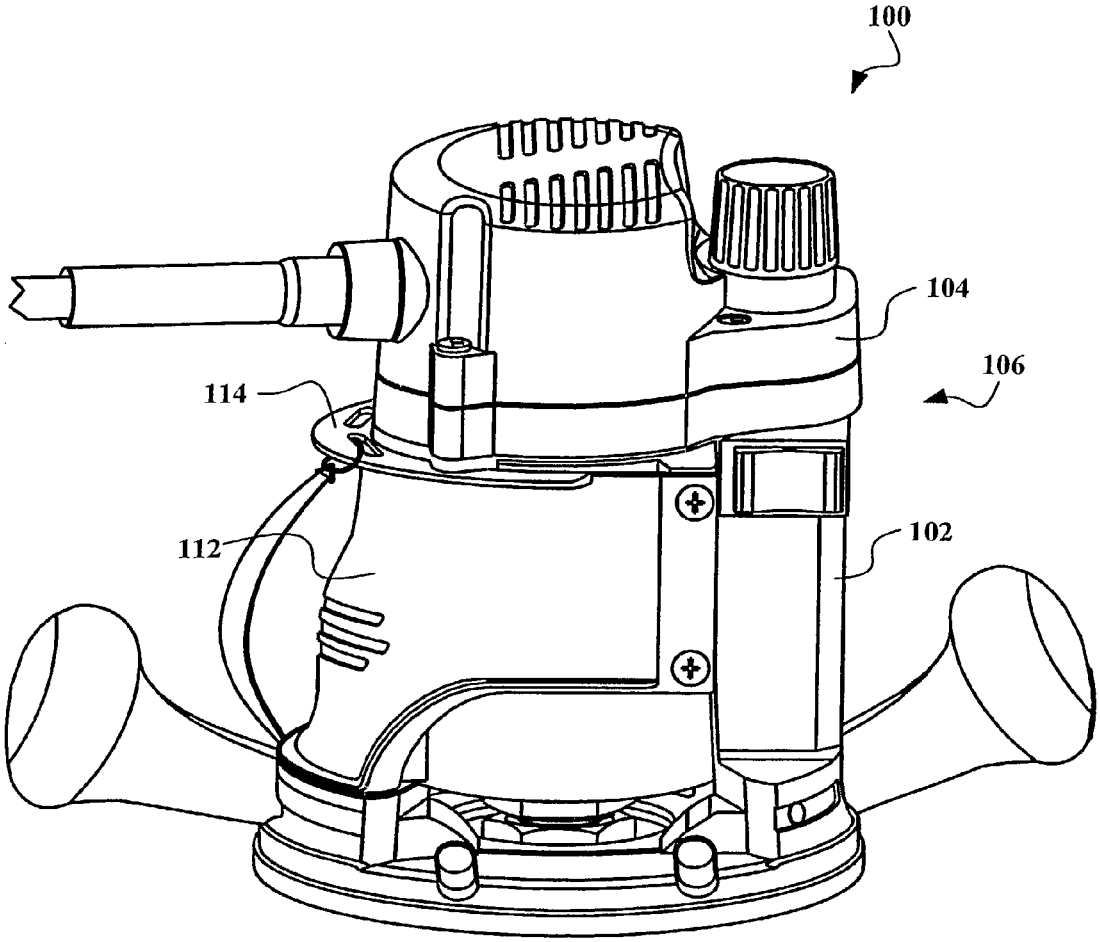
FIG. 1 is an isometric view of a router including hand grip attachment with a support lip terminating generally even with the end of a base.
Figure 2:
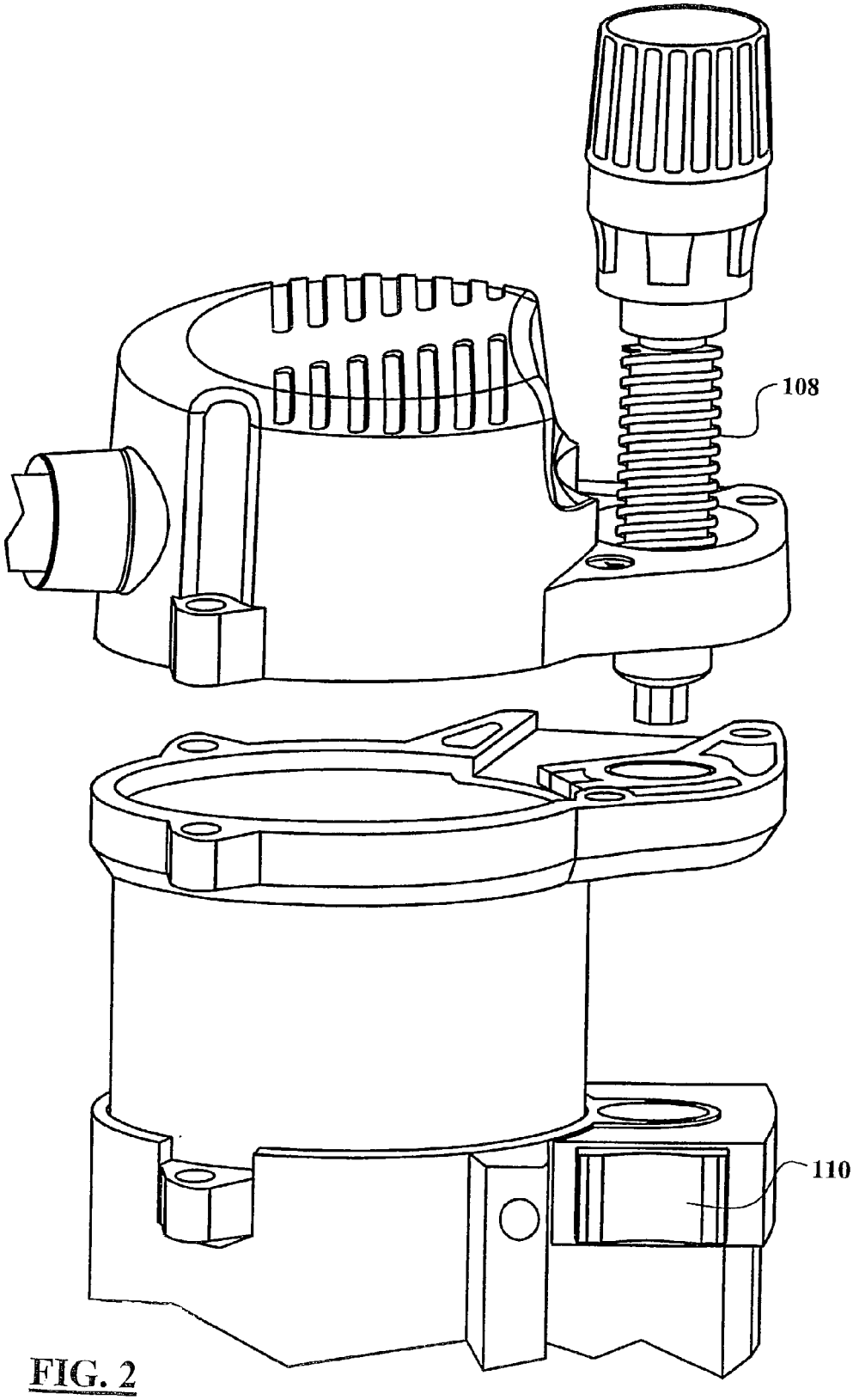
FIG. 2 is an exploded view of a router with a motor housing including an angled portion, for minimizing pinching, adjacent to a base.

Referring to FIG. 1, a router 100 is shown. A base 102 and motor housing 104 are included in the router 100. The base 104 is suitable for supporting the router 100 when the motor housing 104 is upwardly directed. The base 102 adjustably secures the motor housing 104. For example, the motor housing is capable of being adjusted with respect to the base 102, such that the router may achieve various cut depths when implemented with a router bit. Typically, bases include a furcation which may be drawn together by means of a clamping mechanism. In additional embodiments, a friction lock may be employed to secure the motor housing within the base. An adjustment mechanism 106 is further included in the router 100.

The adjustment mechanism includes a shaft 108, with a threaded portion, and a thread engaging member 110. The engaging member 110 contains a lug or ridge for alternately engaging and releasing at least a portion of the threads included on the shaft 108. The engaging member 110 may be biased, so the lug engages the shaft when unactuated. For instance, the engaging member 110 is biased by a spring so the motor housing is secured in a first orientation. When a user depresses the engaging member the lug and threads may disengage resulting in a second orientation being obtained. Additionally, fine depth adjustment may be achieved by rotating the shaft 108.

A hand grip attachment 112 is connected to the exterior of the base 102. The hand grip attachment 112 includes a lip 114 for at least partially supporting the router when grasped. The lip 114 extends generally outwardly from the exterior of the base. The portion of the lip 114 adjacent to the motor housing 104 of the present embodiment is either even with or less than the end of the base 102. For example, the lip may be even with the base adjacent to the motor housing 104. In a further embodiment, the top of the lip is below the end of the base. By orientating the top of the lip even with or below the end of the base a user is less likely to have their hand or fingers caught between the lip and the motor housing. For example, an unwary user's hand may be pinched between the motor housing and hand grip attachment during adjustment.

In further examples, the motor housing and/or the top of the lip generally opposing the housing may be angled away from the other so as to further minimize the pinch point. See generally FIG. 2, wherein the motor housing is angled generally away from the base/lip to minimize pinching.

In an additional aspects, a motor housing is contoured for grasping by a user. For instance, the motor housing is shaped so a user may pinch the motor housing between their fingers and thumb when adjusting depth. Supporting the motor housing in the previous manner may prevent the motor housing from dropping suddenly while changing depth, while promoting safety. In additional embodiments, the motor housing includes a lip for at least partially supporting the motor housing when grasped. Moreover, the motor housing may include an elastomeric coating or formed at least partially of elastomeric material to promote user comfort and minimize muscle fatigue.

Figure 3:
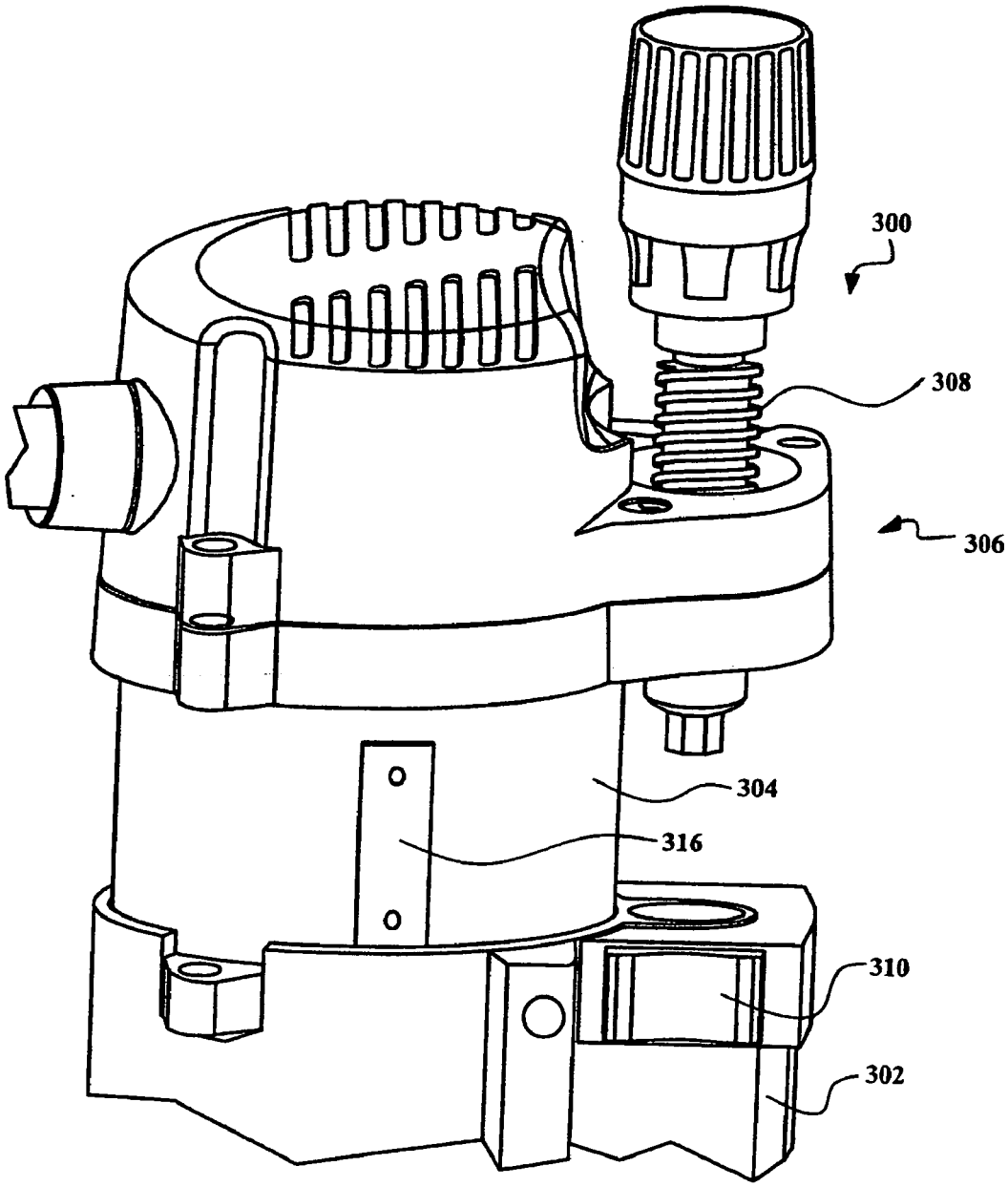
FIG. 3 is an exploded view of a router adjustment device including a frictional zone for generally minimizing rapid course adjustment.

Referring to FIG. 3, a router adjustment device 300 is shown. The adjustment device 300 includes a base 302, a motor housing 304, and an adjustment mechanism 306. The adjustment mechanism includes a shaft 308, with a threaded portion, and a thread engaging member 310. The base 302, motor housing 304 and adjustment mechanism 306, including the shaft and engaging member 310 operate substantially as described with respect to FIGS. 1 and 2. The router adjustment device 300, of the present embodiment, includes a frictional zone 316. A frictional zone is included to at least partially resist the movement of the motor housing 304 with respect to the base. The frictional zone 316 is disposed either on the portion of the motor housing 304 received in the base or is disposed in an interior recess of the base 302.

A frictional zone permits course adjustment, via disengaging the engaging member 310, and fine adjustment, via rotation of the shaft 308. The frictional zone at least partially inhibits rapid course adjustment which would damage the device 300 or potentially injure a user.

Frictional zones may be formed of brass, ceramic material, polymeric materials, elastomeric materials and the like for increasing the coefficient of friction between the friction zone and the generally opposing surface, such as the base. The increase in the coefficient of friction is greater than the coefficient of friction provided by a router or device not containing at least one frictional zone. For instance, the static coefficient of friction between the zone and opposing surface is between $0.15\mu$ and $0.58\mu$, so as to permit adjustment while offering resistance, and thus increased safety.

In additional examples, a second frictional zone is employed to generally oppose the first frictional zone 316. In examples where two frictional zones are employed, the first and second frictional zones are disposed generally opposite with one zone disposed on the base and the other disposed on the motor housing.

Figure 4A:
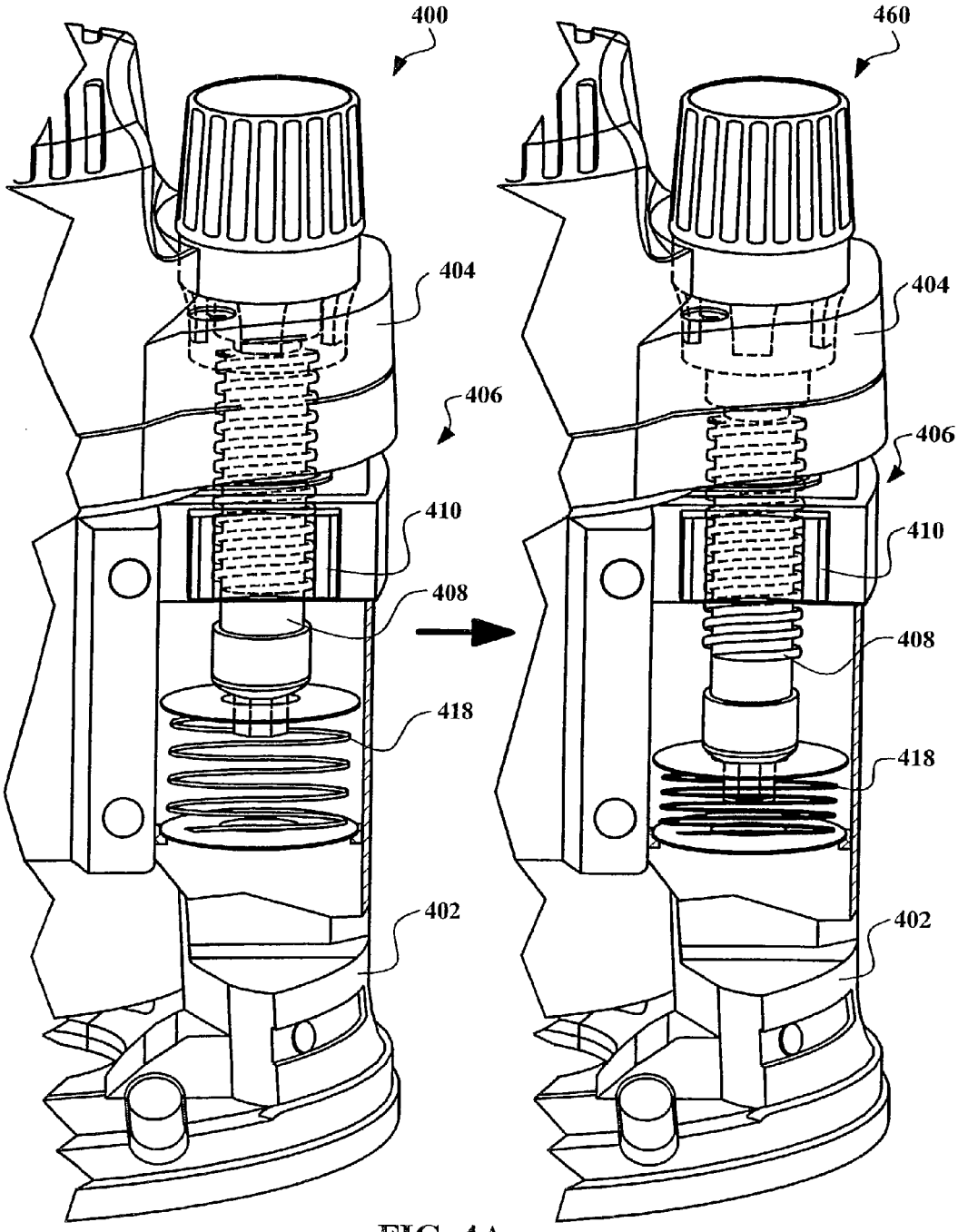
FIG. 4A is a cut-a-way view of an apparatus for controlling router adjustment including a compression spring for minimizing rapid adjustment.
Figure 4B:
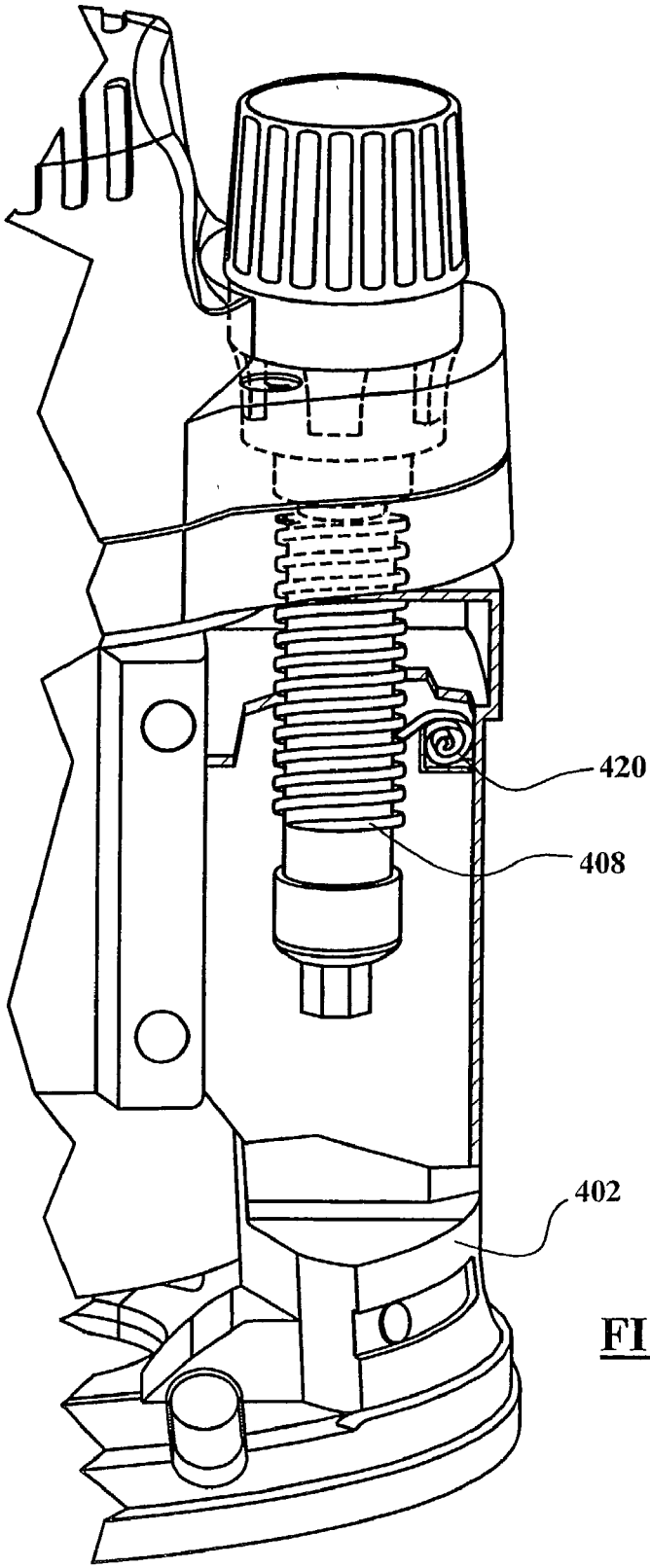
FIG. 4B is a cut-a-way view of an apparatus for controlling router adjustment including a coiled spring with lever arm for minimizing rapid adjustment.
Figure 4C:
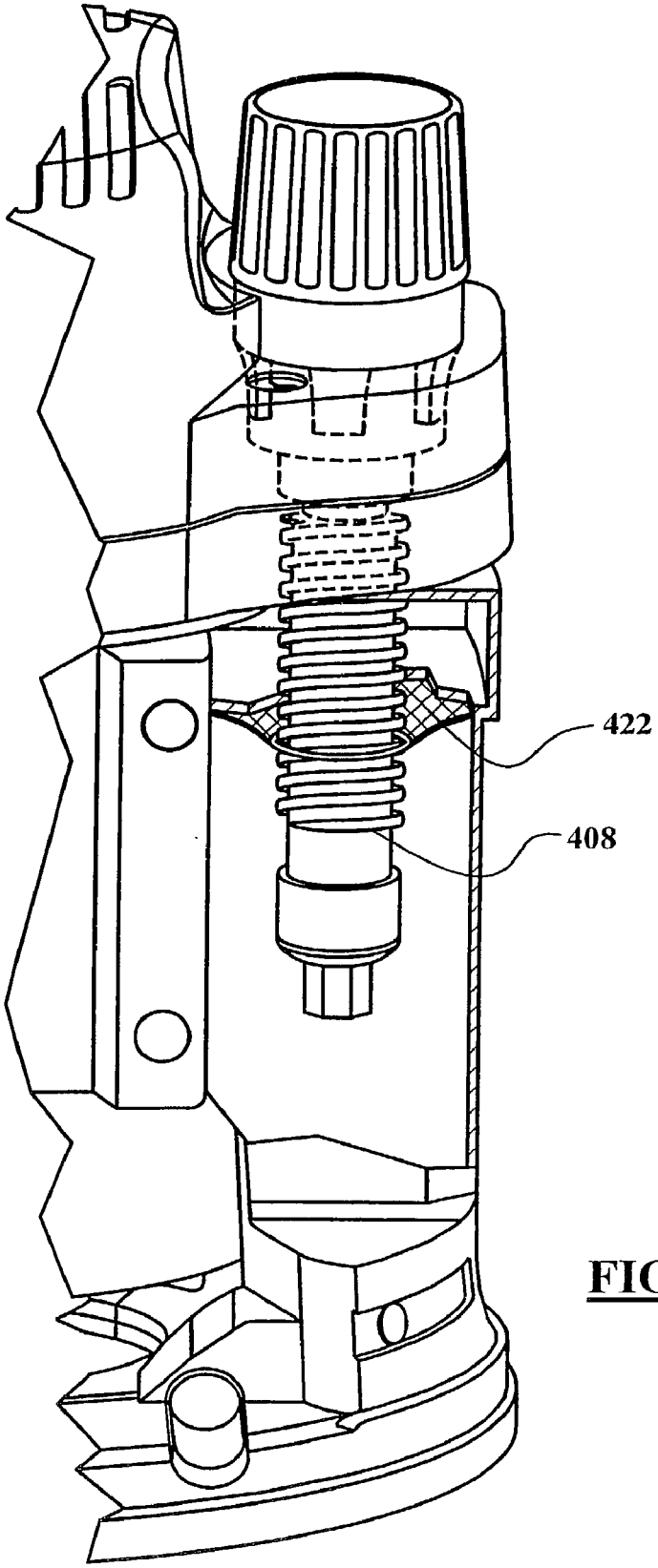
FIG. 4C is a cut-a-way view of an apparatus for controlling router adjustment including a gasket for minimizing rapid adjustment.

Referring to FIGS. 4A, 4B and 4C an apparatus 400 for controlling router adjustment is discussed. The apparatus 400 includes a base 402, a motor housing 404 and adjustment mechanism 406, which operate substantially a previously described.

Referring to FIG. 4A, in a first example, a compression spring 418 is disposed in the base 402 so the shaft 408 is generally biased. For instance, when the shaft 408 included in the adjustment mechanism 406 is disengaged from the engaging member 410 the spring at least partially supports the shaft, and thus the motor housing, such as by contacting a shoulder included on the shaft 408. By implementing the present apparatus when the engagement member 410 is disengaged from the shaft the spring acts to prevent rapid adjustment which may damage the apparatus or injure the user. The present apparatus retains the ability to permit a wrench to interact with a mechanical connection included on the shaft to permit base end adjustment. In additional examples, a washer may be disposed on the end of the spring 408 contacting the shaft for providing a suitable interface for the spring/shaft.

Referring to FIG. 4B, in a second example, a biased lever is disposed in the base 402 adjacent to the threaded portion of the shaft 408. In the present example a coiled spring with a lever arm 420 is utilized. The lever 420 acts to at least partially restrain the longitudinal movement of the threaded shaft by alternately engaging and releasing the threads. For example, when the thread engaging member is disengaged from the shaft 408, the lever 420 may permit gradual change.

Referring to FIG. 4C, in a further example, a gasket 422 formed of elastomeric or polymeric material is disposed in the base adjoining the shaft 408, included in the apparatus 400. For instance, the gasket 422 is formed of a semi-rigid plastic which couples to the shaft to at least partially restraining the shaft during longitudinal travel, such as when the shaft 408 is disengaged from the thread engaging member. Additionally, an inner ring formed of a metal such as brass, a ceramic and the like may be utilized to increase the durability of the gasket 422. For instance, a gasket may include a washer with a metallic inner ring surrounded by an elastomeric material such that the inner ring contacts the shaft 408.

Figure 4D:
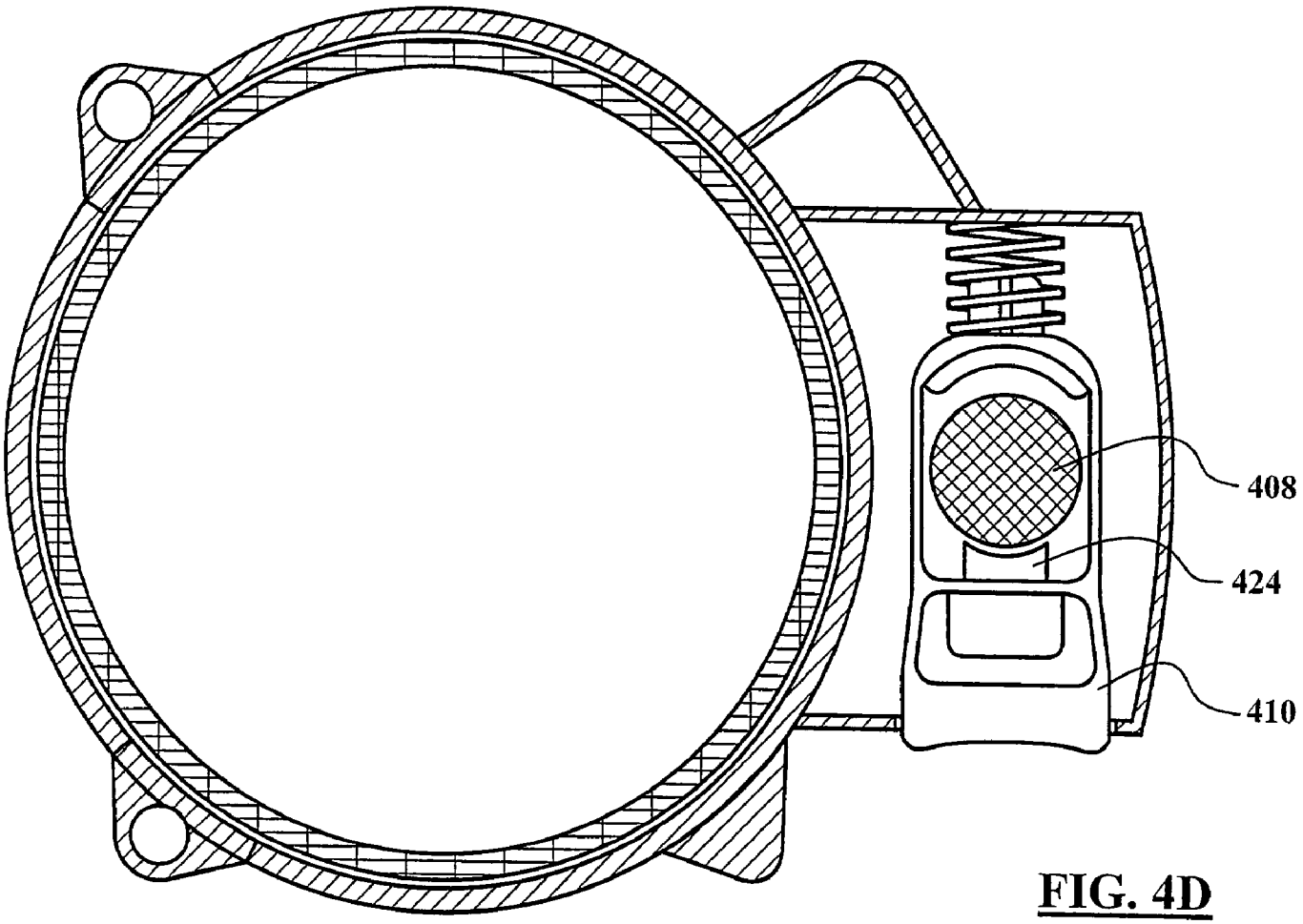
FIG. 4D is a cut-a-way view of an apparatus for controlling router adjustment including a frictional zone mounted to a thread engaging member for minimizing rapid adjustment.

Referring to FIG. 4D, in an additional example, a frictional zone 424 is attached to the thread engaging member 410. The frictional zone 424 is disposed in the aperture generally opposite the lug or ridge for engaging the threads included on the shaft 408. The frictional zone may contact the shaft 408, thus retarding the longitudinal motion of the shaft, such as when the shaft is disengaged from the threaded engaging member 410. For instance, when a user inadvertently releases the thread engaging member 410 the frictional zone may come in contact with the shaft, and resulting in a slower travel.

Figure 5A:
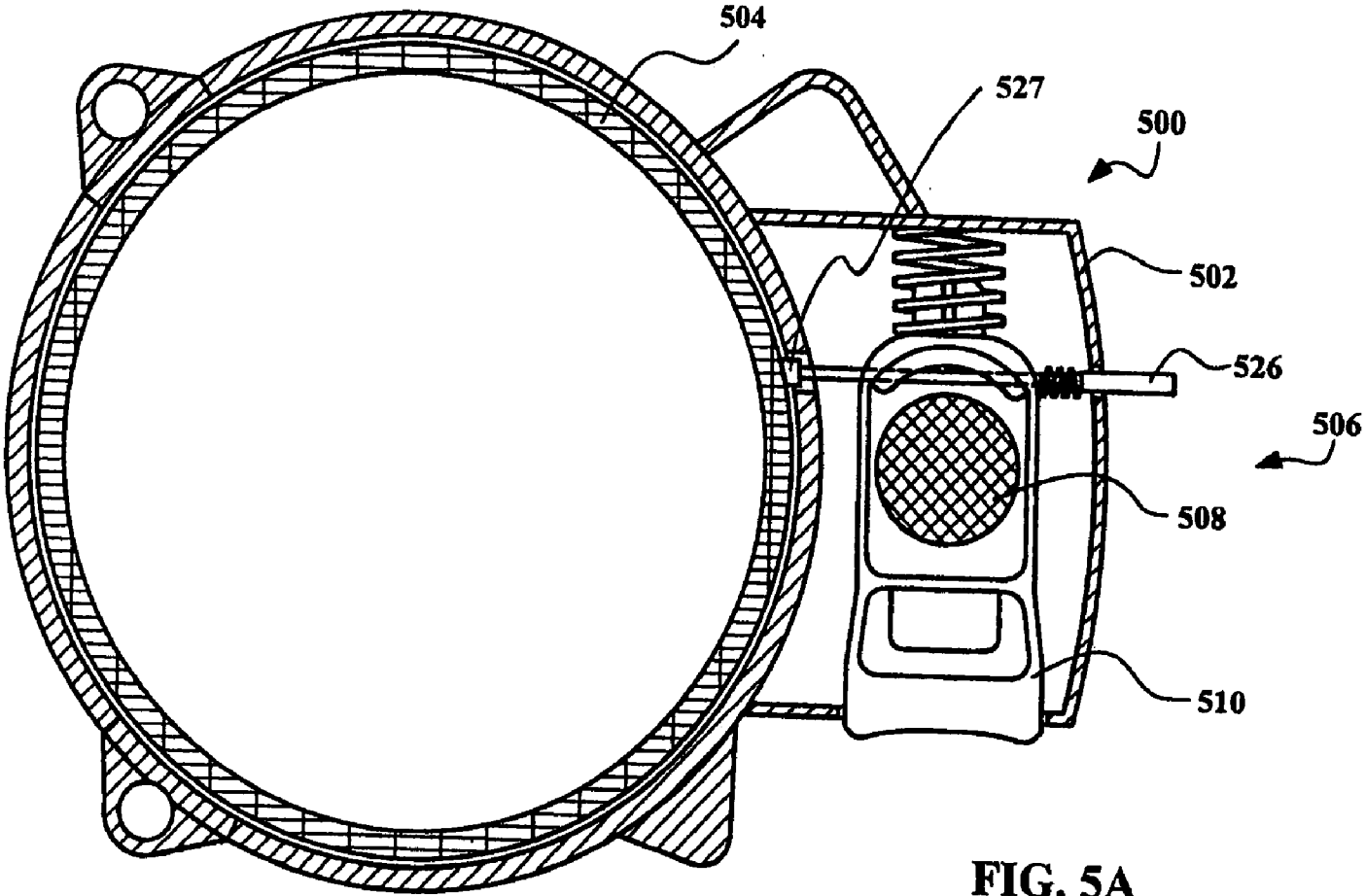
FIG. 5A is cross sectional view of a router adjustment device including a biased breaking element.

Referring now to FIG. 5A, a router adjustment device 500 is shown. The router device 500 includes a base 502, a motor housing 504 and an adjustment mechanism 506, including a shaft 508 and thread engaging member 510. All of the above are substantially similar as discussed previously. The device 500, of the present embodiment, further includes a brake element disposed in the base generally perpendicular to the axis motion for the motor housing 504.

For example, the brake element is a biased pin 526 which is suitable for contacting the motor housing. Preferably, the pin 526 is biased in a disengaged orientation. For example, a user may wish to depress the pin 526, and thus contact the motor housing and at least partially resist or inhibit motor housing motion, such as when performing a course adjustment. The pin 526 may be located so as to permit the user to utilize one hand to manipulate the pin 526 and the thread engaging member 510.

In a further embodiment, the portion of the pin 526 contacting the motor housing may be formed of brass (e.g., a brass plug 527), ceramic material, plastic and the like for at least partially retarding the longitudinal motion of the motor housing without marring the motor housing 504.

Figure 5B:
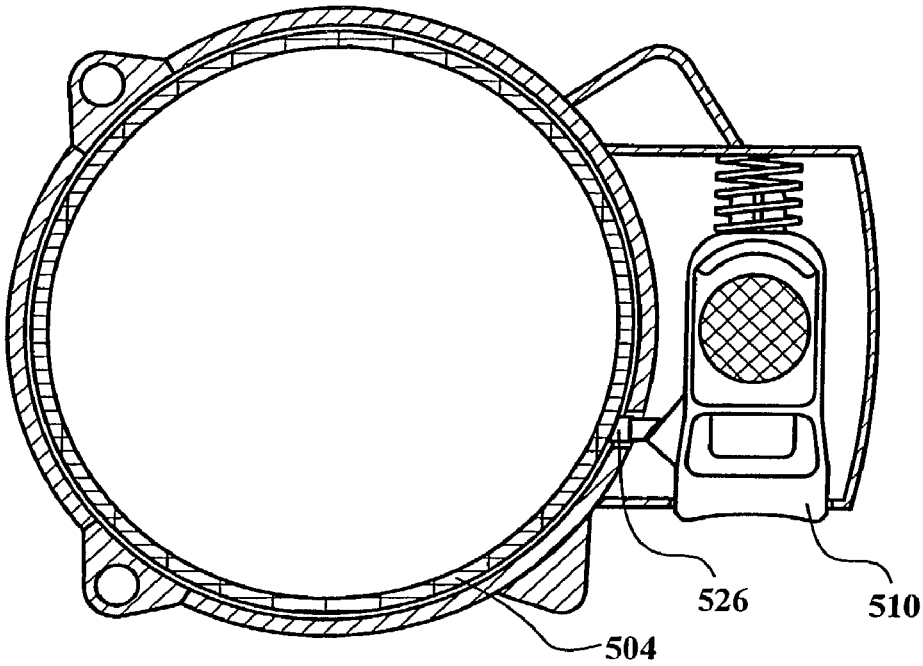
FIG. 5B is cross sectional view of a router adjustment device including a biased breaking element capable of automatic actuation by a thread engaging member.

Referring to FIG. 5B, in an additional example, the biased pin includes an angled end directed towards a generally opposing angled surface included on the thread engagement member 510. Employing the present arrangement, the pin 526 automatically engages when the engaging member 510 is actuated, thus resulting in the pin 526 being forced towards the motor housing 504.

Figure 5C:
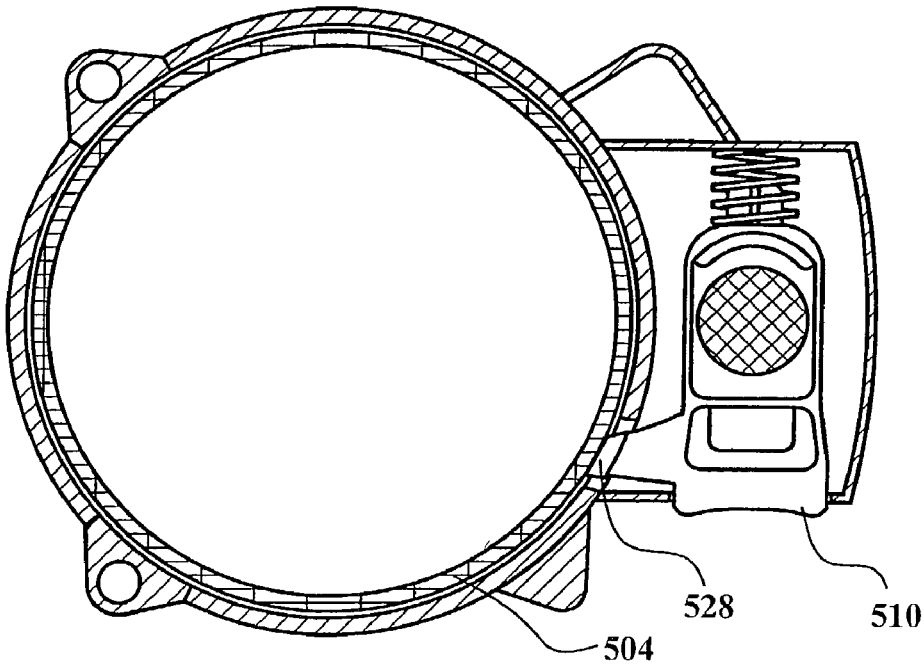
FIG. 5C is cross sectional view of a router adjustment device including a thread engaging member with a contact zone for minimizing rapid course depth adjustment.

Referring now to FIG. 5C, in a further example, a contact zone 528 mounted to the thread engaging member 510. For instance, the thread engaging member 510 includes an angled or curved protrusion, directed towards the motor housing, with a contact zone 528 for contacting the motor housing 504 when the engaging member 510 is pressed. The contact zone may be formed of brass, ceramic material, plastic and the like for at least partially resisting the longitudinal motion of the motor housing without marring the motor housing 504.

It is believed that the apparatus of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An apparatus for controlling router adjustment comprising:

a base for supporting a router;

a motor housing adjustable secured by the base for movement along an axis to a position relative to the base;

an adjustment mechanism for adjusting the position of the motor housing relative to the base, the adjustment mechanism including:

a shaft connected to the motor housing for rotation about an axis and having a threaded portion;

a thread engaging member connected to the base, capable of selectively engaging with the threaded portion; and means for restraining movement of the motor housing with respect to the base, the restraining means being operable for adjustably coupling with the shaft;

wherein the restraining means at least partially restrains movement of the motor housing when the thread engaging member is disengaged.

2. The apparatus of claim 1, wherein the restraining means is a spring aligned with the shaft.

3. The apparatus of claim 1, wherein the restraining means is a rubber gasket.

4. The apparatus of claim 1, wherein the restraining means is a biased lever.

5. The apparatus of claim 1, wherein the restraining means is a frictional zone attached to the thread engaging member.

6. A router adjustment device comprising:

a base for supporting a router;

a motor housing adjustable secured by the base for movement along an axis to a position relative to the base;

an adjustment mechanism for adjusting the position of the motor housing relative to the base, the adjustment mechanism including:

a shaft connected to the motor housing for rotation about an axis and having a threaded portion; and a thread engaging member connected to the base, capable of selectively engaging with the threaded portion;

a brake element disposed in the base generally perpendicular to the axis of movement of the motor housing;

wherein the brake element is selectively engageable for at least partially resisting movement of the motor housing with respect to the base when the thread engaging member is disengaged from the threaded portion of the shaft.

7. The router adjustment device of claim 6, wherein the brake element is biased in an unengaged orientation.

8. The router adjustment device of claim 6, wherein the brake element is a biased pin.

9. The router adjustment device of claim 8, wherein the pin includes a brass plug for contacting the motor housing.

10. The router adjustment device of claim 6, wherein the brake element is disposed on the thread engaging member such that the brake element at least partially engages the motor housing when the thread engaging member is disengaged from the shaft.

11. The router adjustment device of claim 10, wherein the brake element further includes a brass engaging member for contacting the motor housing.

* * * * *